US005249495A

United States Patent [19]

Renk

[11] Patent Number: 5,249,495

[45] Date of Patent: Oct. 5, 1993

[54] SHINGLE CUTTER APPARATUS

[76] Inventor: Ronald D. Renk, 809 Meadowlark Cove, Lafayette, Colo. 80026

[21] Appl. No.: 933,768

[22] Filed: Aug. 24, 1992

[51] Int. Cl.[5] ..... B26D 5/10

[52] U.S. Cl. ..... 83/468.3; 83/468.7; 83/607

[58] Field of Search ..... 83/468.3, 468.2, 468.7, 83/607, 609, 698; 30/289, 290

[56] References Cited

U.S. PATENT DOCUMENTS

| | | | |
|---|---|---|---|
| 413,522 | 10/1889 | Kelsey et al. | 83/468.3 |
| 1,908,703 | 5/1933 | Flatt | 83/607 |
| 1,918,104 | 7/1933 | Hook | 83/607 |
| 3,792,636 | 2/1974 | Pottern | 83/607 |
| 4,934,423 | 6/1990 | Withrow | 83/468.3 |
| 4,957,025 | 9/1990 | Beno | 83/468 |
| 5,044,243 | 9/1991 | Aizawa | 83/609 |

*Primary Examiner*—Frank T. Yost
*Assistant Examiner*—Allan M. Schrock
*Attorney, Agent, or Firm*—Leon Gilden

[57] ABSTRACT

A shingle cutter apparatus includes a rigid base plate having a first end wall spaced from a second end wall, and a first side wall with a cutter anvil directed along the first side wall coplanar with a top surface of the base plate, with a pivotal cutter blade mounted in cooperation with the anvil. A modification of the invention includes an abutment fence pivotally mounted relative to the base plate for effecting cutting of angular cuts relative to a shingle member.

2 Claims, 4 Drawing Sheets

SHINGLE CUTTER APPARATUS

BACKGROUND OF THE INVENTION

1. Field of the Invention

The field of invention relates to shingle cutter apparatus, and more particularly pertains to a new and improved shingle cutter apparatus wherein the same is arranged for ease of manipulation and positioning relative to shingles for their cutting in use.

2. Description of the Prior Art

Shingle cutter apparatus of various types have been presented in the prior art for the cutting of shingle in use upon a building site. The prior art shingle cutting structure have typically lacked stability and compactness in construction to accommodate use. The instant invention attempts to overcome deficiencies of the prior art by providing for a shingle cutting structure utilizing a swing arm cutter blade, in a manner as set forth in the U.S. Pat. Nos. 4,957,025 and 4,967,628.

Accordingly, it may be appreciated there continues to be a need for a new and improved shingle cutter apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shingle cutter apparatus now present in the prior art, the present invention provides a shingle cutter apparatus wherein the same is arranged to provide for an open top surface accommodating shingles relative to a pivoting knife blade. As such, the general purpose of the present invention, which will be described subsequently in greater detail, is to provide a new and improved shingle cutter apparatus which has all the advantages of the prior art shingle cutter apparatus and none of the disadvantages.

To attain this, the present invention provides a shingle cutter apparatus including a rigid base plate having a first end wall spaced from a second end wall, and a first side wall with a cutter anvil directed along the first side wall coplanar with a top surface of the base plate, with a pivotal cutter blade mounted in cooperation with the anvil. A modification of the invention includes an abutment fence pivotally mounted relative to the base plate for effecting cutting of angular cuts relative to a shingle member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shingle cutter apparatus which has all the advantages of the prior art shingle cutter apparatus and none of the disadvantages.

It is another object of the present invention to provide a new and improved shingle cutter apparatus which may be easily and efficiently manufactured and marketed.

It is a further object of the present invention to provide a new and improved shingle cutter apparatus which is of a durable and reliable construction.

An even further object of the present invention is to provide a new and improved shingle cutter apparatus which is susceptible of a low cost of manufacture with regard to both materials and labor, and which accordingly is then susceptible of low prices of sale to the consuming public, thereby making such shingle cutter apparatus economically available to the buying public.

Still yet another object of the present invention is to provide a new and improved shingle cutter apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
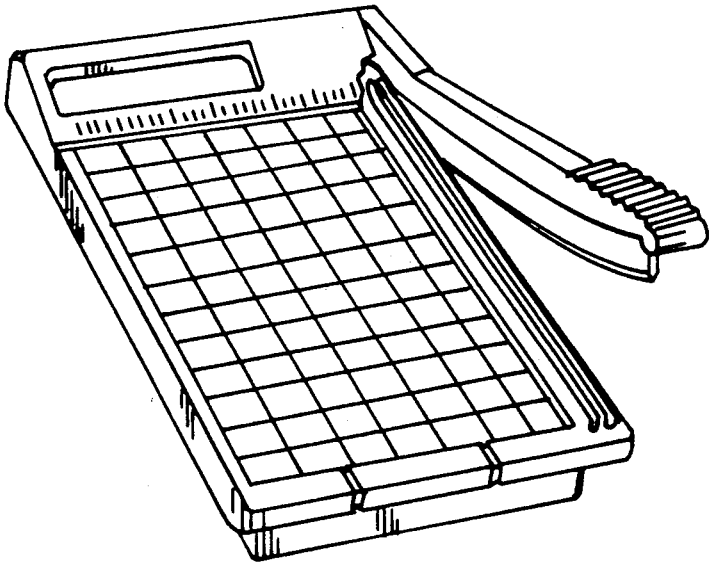
FIG 1 PRIOR ART
FIG. 1 is an isometric illustration of a prior art paper cutter structure, as indicated in U.S. Pat. No. 4,957,025.
Figure 2:
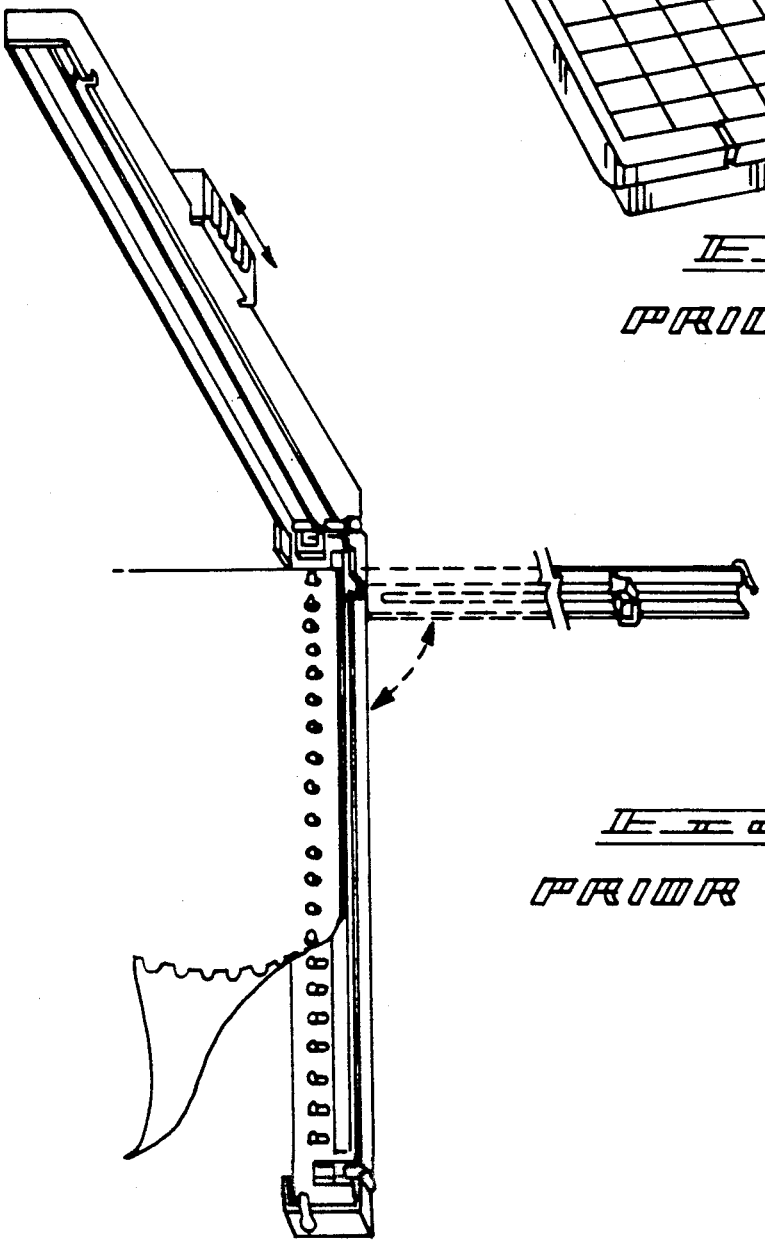
FIG 2 PRIOR ART
FIG. 2 is an isometric illustration of a further example of a paper cutter and trimming apparatus utilizing a pivotal blade structure, as indicated in U.S. Pat. No. 4,967,628.
Figure 3:
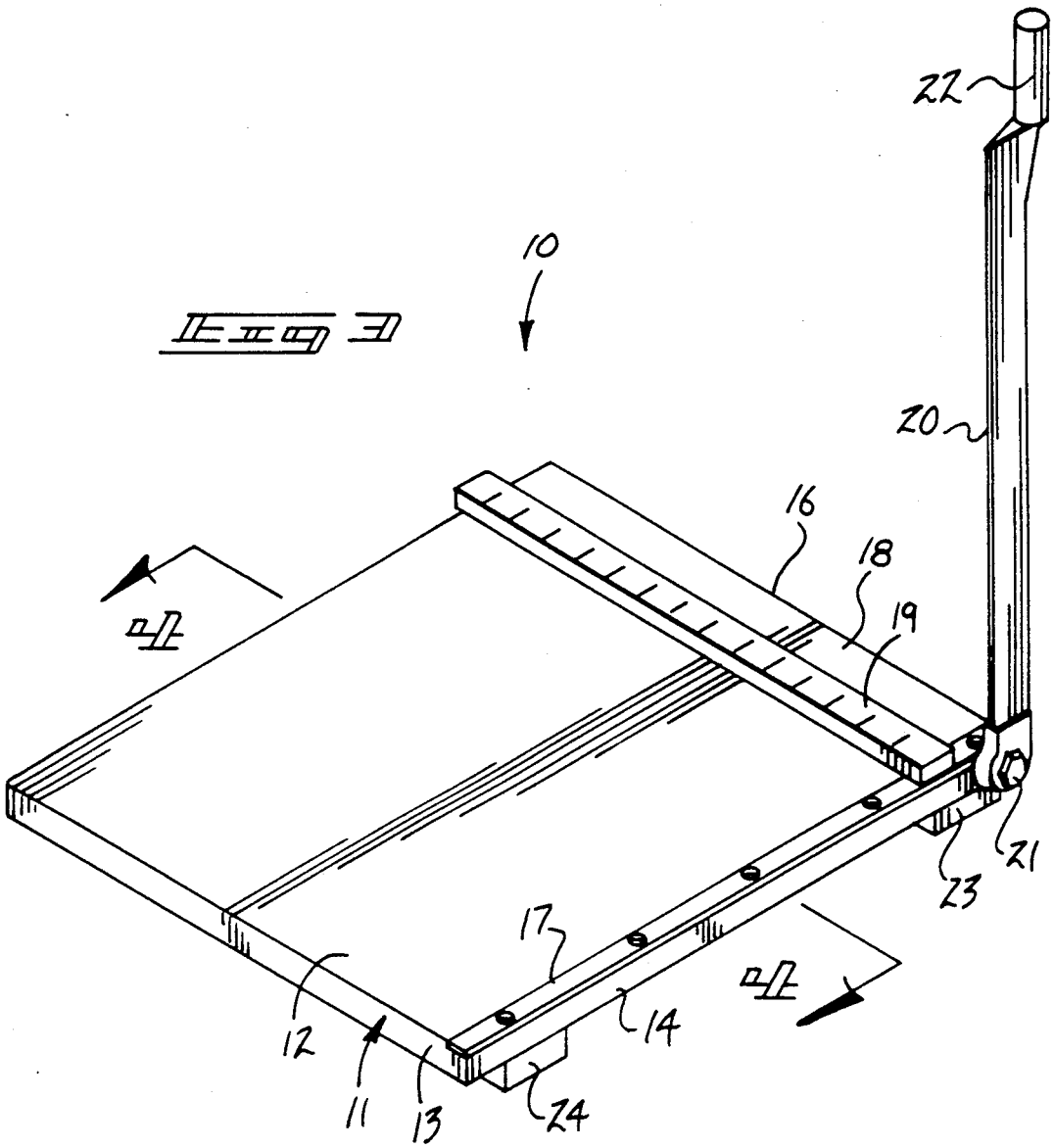
FIG. 3 is an isometric illustration of the instant invention.
Figure 4:
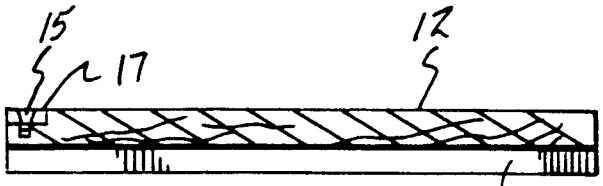
FIG. 4 is an orthographic view, taken along the lines 4—4 of FIG. 3 in the direction indicated by the arrows.

With reference now to the drawings, and in particular to FIGS. 1 to 7 thereof, a new and improved shingle cutter apparatus embodying the principles and concepts of the present invention and generally designated by the reference numeral 10 will be described.

More specifically, the shingle cutter apparatus 10 of the instant invention essentially comprises a rigid base plate 11 having a planar top surface 12 spaced from a planar bottom surface. The base plate 11 includes a first end wall 13 orthogonally oriented relative to a first side wall 14. A second end wall 16 is spaced from and parallel the first end wall 14. A top surface recess 15 includes a recess floor parallel to the planar top surface 12 and extends coextensively from the first end wall 13 to the second end wall 16 coextensive with the first side wall 14 in communication therewith. A metallic anvil blade 17 is fixedly mounted within the top surface recess 15 that is in turn coplanar with the planar top surface 12. An end wall abutment 18 orthogonally oriented relative to the first side wall 14 extends coextensively with the second end wall 16. A gradation fence plate 19 extends along the end wall abutment 18 coextensively therewith. A cutter blade 20 is arranged having a pivot axle 21 that is directed orthogonally into the first side wall 14 in adjacency to the second end wall 16, with a cutter blade handle 22 mounted at an opposed distal end of the cutter blade 20 relative to the pivot axle 21 to permit directing the cutter blade 20 in cooperation with the anvil blade 17 to sever shingle members mounted along the planar top surface 12 extending beyond the first side wall 14.

Respective rear and forward leg plates 23 and 24 arranged in a parallel relationship relative to one another in adjacency relative to the respective second and first end walls 16 and 13 arranged parallel to the end walls are oriented to space the base plate 11 relative to an underlying support surface such as roof top in the cutting of shingle members.

Figure 5:
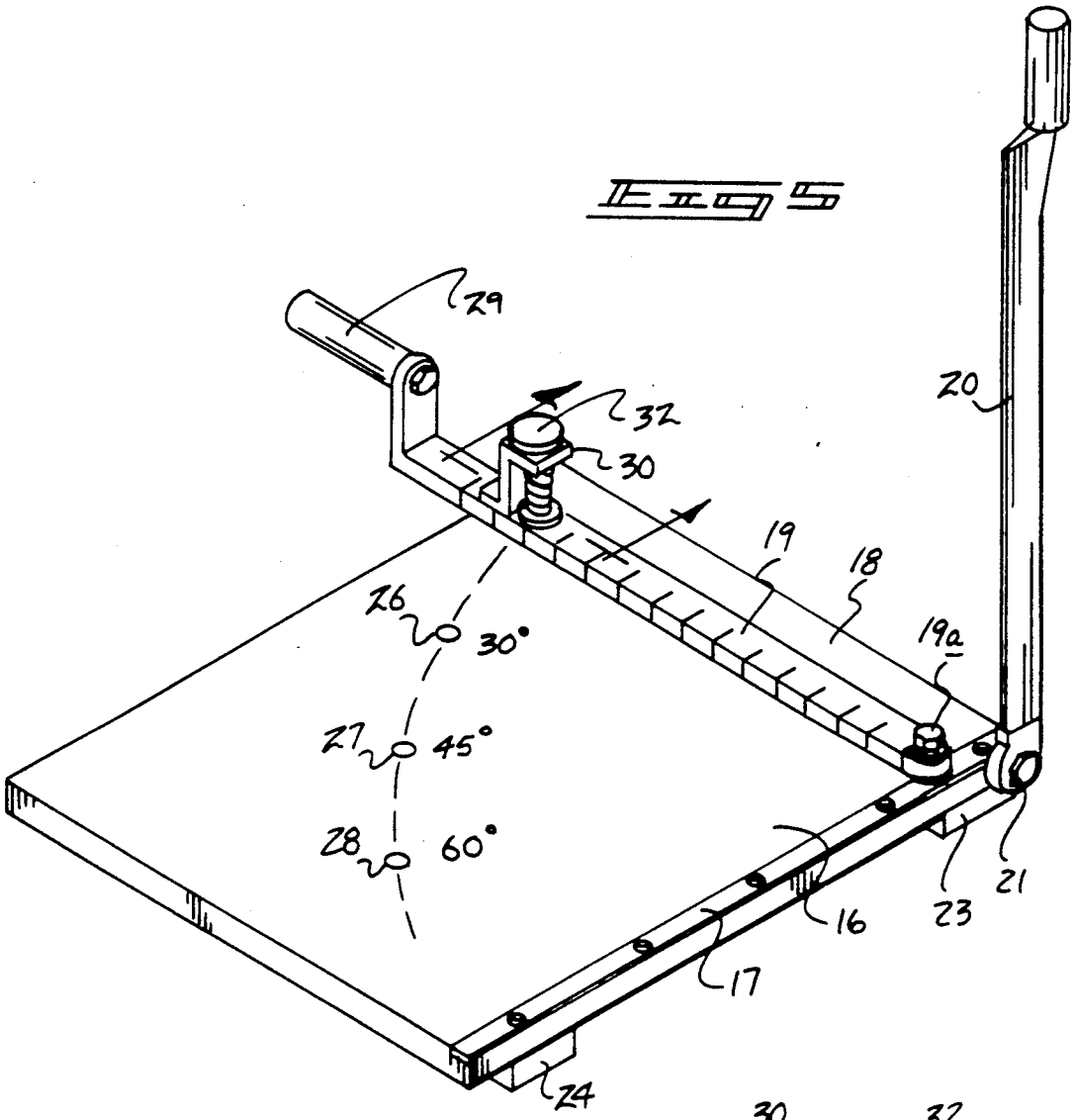
FIG. 5 is an isometric illustration of the invention utilizing an adjustable fence plate.
Figure 6:
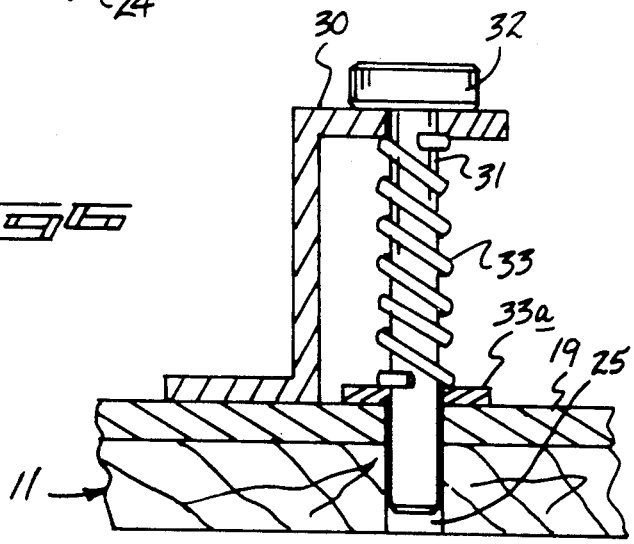
FIG. 6 is an orthographic view, taken along the lines 6—6 of FIG. 5 in the direction indicated by the arrows.

The FIG. 5 for example indicates a modified fence plate structure having a fence plate handle mounted to the fence plate extending laterally of the base plate, with the fence plate having a fence plate pivot axle 19*a* at an opposed distal end relative to the handle 29 directed into the top surface 12 of the base plate 11. A first lock bore 25 is orthogonally directed into the base plate in adjacency to the abutment wall 18. Respective second, third, and fourth lock bores 26, 27, and 28 spaced an equal predetermined spacing or radius from the fence plate pivot axle 19*a* to each of the respective bores 25–28 are arranged in a spaced relationship to provide for pivoting of the fence plate 19 from a first position oriented parallel to the abutment wall to a second position oriented substantially thirty degrees relative to the abutment wall; to a third position oriented substantially forty-five degrees to the abutment wall; and subsequently to a fourth position oriented at substantially sixty degrees relative to the abutment wall when an associated lock rod 31 is selectively directed within one of the respective first, second, third, and fourth lock bores 25, 26, 27, and 28. The lock bores as noted are orthogonally directed into the base plate extending therethrough from the top surface 12. The lock rod 31 is mounted to a support flange 30, that in turn is secured to the fence plate 19. The lock rod 31 includes a lock rod head 32 positioned above the support flange 30, and a lock rod spring 33 captured between the support flange 30 and the fence plate 19, in a manner as indicated in FIG. 6 for example. The spring in this manner biases the lock rod through the fence plate into communication with one of the lock bores as noted. A capture flange 33*a* is fixedly mounted to the lock rod 31 and is arranged to effect biasing of the lock rod, in a manner as noted above, with the spring 33 captured between the capture flange 33*a* and the support flange 30, with the capture flange positioned above the fence plate 19.

Figure 7:
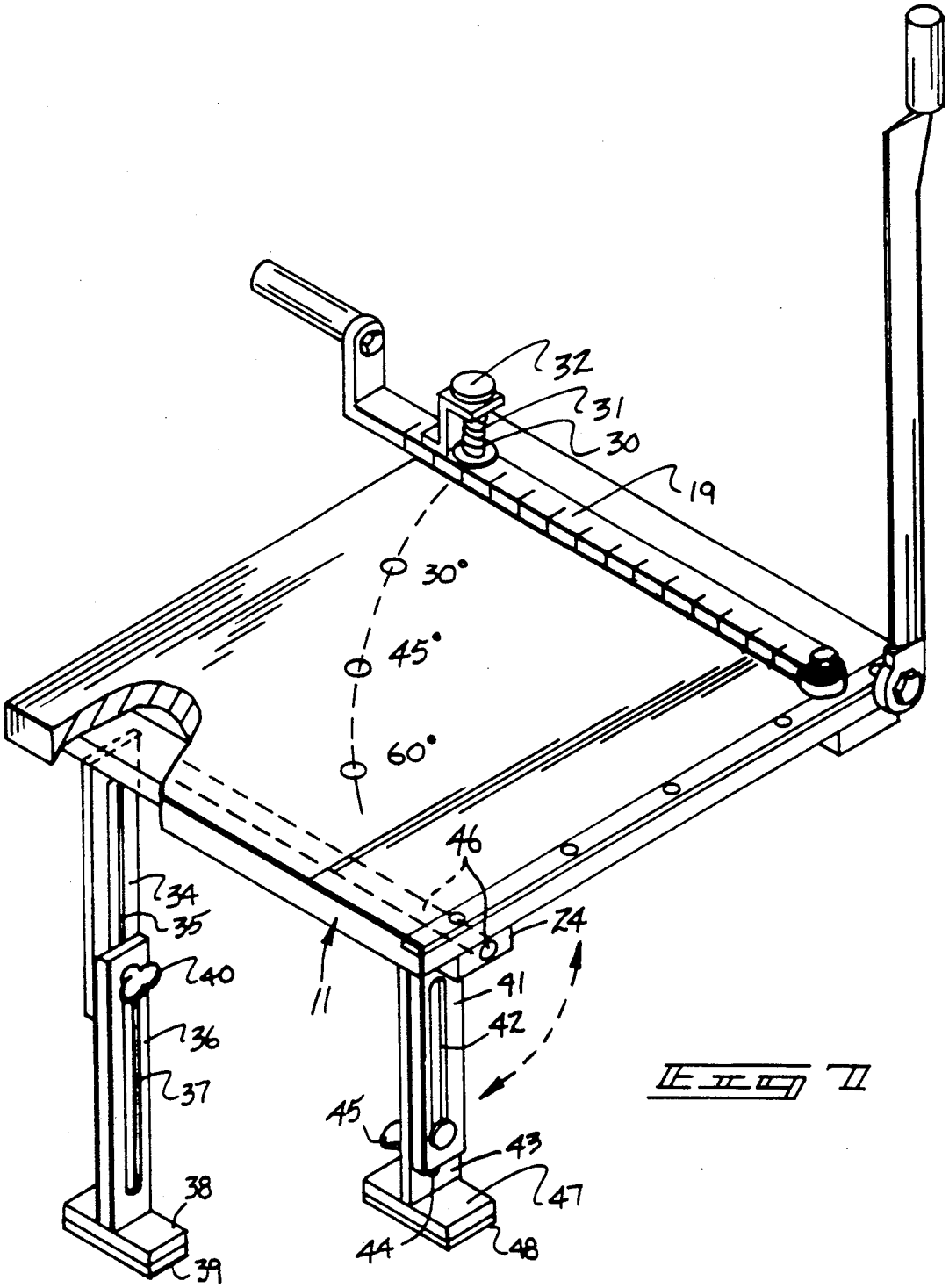
FIG. 7 is an isometric illustration of a further modified aspect of the invention.

The FIG. 7 indicates the use of leg plate structure pivotally mounted relative to the forward leg plate 24. The leg plate structure includes a first and second leg plate 34 and 36 having respective first and second leg plate slots 35 and 37, with a first lock fastener 40 directed through the first and second leg plate slots 35 and 37 to permit securing of the first and second leg plates in a relatively extended orientation relative to one another. A second leg plate foot 38 includes a resilient foot pad 39 to provide for a frictionally engaging surface relative to an underlying slanted roof. Similarly, third and fourth leg plates 41 and 43 are provided having respective third and fourth leg plate slots 42 and 44, with second lock fastener 45 directed through the third and fourth leg plate slots 42 and 44 to permit telescoping securement of the third and fourth leg plates relative to one another. The first and third leg plates are pivotally mounted about a pivot axle rod 46 directed through the forward leg plate 24. Similarly, a fourth leg plate foot 47 includes a fourth leg plate pad 48 of resilient construction. In this manner, extension of the leg plate structure permits the level orientation of the base plate when the cutter structure is mounted to a slanted underlying roof support when utilized upon a roof structure in the cutting of shingles.

It should be noted that the pivot axle rod 46 is threadedly directed through the forward leg plate 24 having a screw driver receiving slot, whereupon tightening of the pivot axle rod 46 effects tightening and latching of the first and third leg plates relative to the forward leg plate when orienting the leg plates in an extended orientation to accommodate a pitch and slanted roof surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shingle cutter apparatus, comprising, a rigid base plate, wherein the base plate includes a planar top surface spaced from a planar bottom surface, and the base plate having a first end wall spaced from a second end wall, and a first side wall extending orthogonally between the first end wall and the second end wall, and a top surface recess coextensively directed along the first side wall orthogonally oriented between the first end wall and the second end wall, and a metallic anvil blade fixedly mounted within the recess, and an abutment wall coextensive with the second end wall orthogonally oriented relative to the first side wall projecting above the planar top surface, with a graduated fence plate coextensively oriented along the abutment wall coextensively therewith, and a cutter blade, with the cutter blade including a pivot axle orthogonally directed into the first side wall below the abutment wall, the cutter blade having a predetermined length, the anvil blade having a length equal to said predetermined length, and a handle mounted to the cutter blade spaced from the pivot axle, and a rear leg plate mounted to the plate bottom surface in adjacency to the second end wall, and a forward leg plate parallel to the rear leg plate mounted to the planar bottom surface in adjacency to the first end wall, and the fence plate includes a fence plate pivot axle orthogonally directed into the planar top surface in adjacency to the anvil blade, and the fence plate having a fence plate handle extending above and longitudinally of the fence plate for manual manipulation of the fence plate, and the base plate having a first lock bore, a second lock bore, a third lock bore, and a fourth lock bore, each spaced a predetermined radial spacing relative to the fence plate pivot axle in a semi-annular array extending from the abutment wall, and lock means cooperative with the first lock bore, the second lock bore, the third lock bore, and the fourth lock bore selectively for permitting selective orientation of the fence plate in a first position, a second position, a third position, and a fourth position, wherein the lock means in registration with the first lock bore, the second lock bore, the third lock bore, and the fourth lock bore respectively, and the lock means includes a support flange fixedly mounted to the fence plate extending above the fence plate, and a lock rod slidably directed through the support flange and orthogonally directed through the fence plate, with the lock rod including a lock rod head positioned above the support flange, and a lock rod spring positioned below the support flange, and a capture flange fixedly mounted to the lock rod below the support flange, with a lock rod spring captured between the support flange and the capture plate to bias the lock rod through the fence plate into selective registration within one of said first lock bore, second lock bore, third lock bore, or fourth lock bore selectively, and the forward leg plate includes a pivot axle rod directed therethrough, and a first leg plate pivotally mounted to the pivot axle rod, and a third plate pivotally mounted to the pivot axle rod, with the first leg plate including a first leg plate slot, the third leg plate including a third leg plate slot, and a second leg plate having a second leg plate slot pivotally mounted to the first leg plate, with a first lock fastener directed through the first leg plate slot and the second leg plate slot to selectively orient the first leg plate relative to the second leg plate, and a fourth leg plate having a fourth leg plate slot pivotally mounted to the third leg plate, with a second lock fastener directed through the third leg plate slot and the fourth leg plate slot to selectively adjust positioning of the third leg plate relative to the fourth leg plate.

2. An apparatus as set forth in claim 1 wherein the second leg plate includes a second leg plate foot orthogonally and fixedly mounted to the second leg plate below the second leg plate slot, the fourth leg plate having a fourth leg plate foot orthogonally and fixedly mounted to the fourth leg plate below the fourth leg plate slot, and the second plate having a first resilient pad, and the fourth leg plate foot having a second resilient pad for frictionally engaging an underlying surface.

* * * * *